US010090580B2

(12) United States Patent
Cheng

(10) Patent No.: US 10,090,580 B2
(45) Date of Patent: Oct. 2, 2018

(54) ANTENNA STRUCTURE AND WIRELESS COMMUNICATION DEVICE USING SAME

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventor: Ren-Tsung Cheng, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 48 days.

(21) Appl. No.: 15/252,843

(22) Filed: Aug. 31, 2016

(65) Prior Publication Data

US 2017/0346158 A1 Nov. 30, 2017

(30) Foreign Application Priority Data

May 28, 2016 (TW) ..... 105116786

(51) Int. Cl.

| | |
|---|---|
| ***H01Q 1/24*** | (2006.01) |
| ***H01Q 5/392*** | (2015.01) |
| ***H01Q 1/50*** | (2006.01) |

(52) U.S. Cl.
CPC ..... *H01Q 1/243* (2013.01); *H01Q 1/50* (2013.01); *H01Q 5/392* (2015.01)

(58) Field of Classification Search
CPC ..... H01Q 1/243
USPC ..... 343/702
See application file for complete search history.

(56) References Cited

U.S. PATENT DOCUMENTS

| | | | | |
|---|---|---|---|---|
| 7,046,204 | B2 | 5/2006 | Satoh et al. | |
| 2015/0171506 | A1* | 6/2015 | Murakami | H01Q 21/30 343/702 |

FOREIGN PATENT DOCUMENTS

| | | | |
|---|---|---|---|
| CN | 100438207 | C | 11/2008 |
| CN | 100586128 | C | 1/2010 |
| TW | I263372 | B | 10/2006 |
| TW | 201401649 | A | 1/2014 |

* cited by examiner

*Primary Examiner* — Graham Smith
(74) *Attorney, Agent, or Firm* — ScienBiziP, P.C.

(57) ABSTRACT

An antenna structure is used in a wireless communication device. The antenna includes an antenna portion. The antenna portion includes a base, a first antenna and at least one second antenna. The first antenna is received in the base, the at least one second antenna is rotatably connected to the base.

18 Claims, 10 Drawing Sheets

ANTENNA STRUCTURE AND WIRELESS COMMUNICATION DEVICE USING SAME

FIELD

The disclosure generally relates to antenna structures, and particularly to a multiband antenna and a wireless communication device using the multiband antenna.

BACKGROUND

With the development of the fourth generation of mobile phone mobile communication technology standards generation (4G), an antenna becomes one of the most important components of an wireless communication device. Long term evolution (LTE) used in the 4G network can be divided into Frequency-Division Duplex (FDD) LTE and Time-Division Duplex (TDD) LTE and includes thirty-six kinds of frequency bands. Therefore, it is necessary to make the antenna of the 3G network can also operate at the frequency bands of the 4G network.

BRIEF DESCRIPTION OF THE DRAWINGS

Many aspects of the present disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
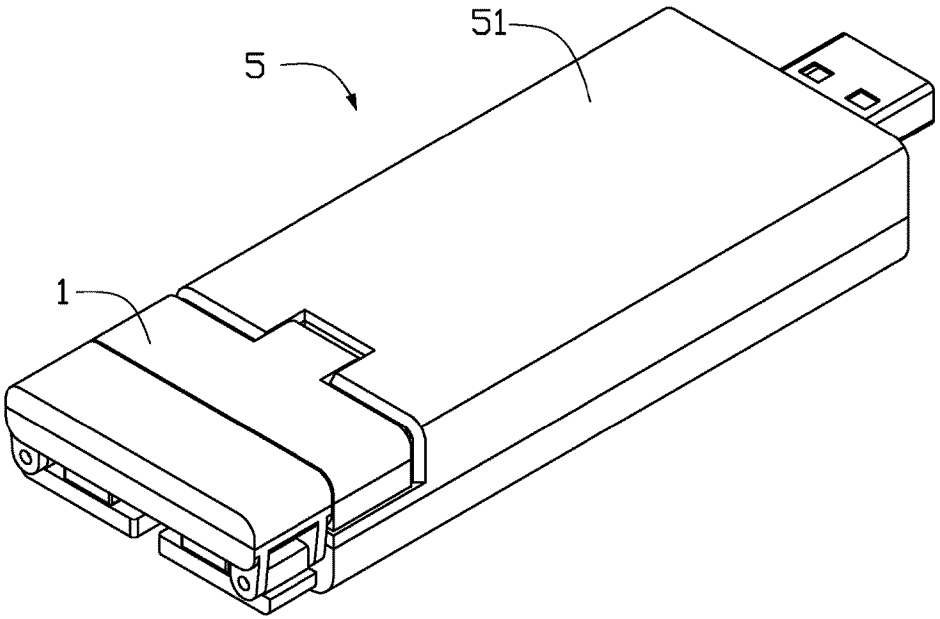
FIG. 1 is an isometric view of one exemplary embodiment of a wireless communication device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiment described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

FIG. 1 shows an isometric view of one exemplary embodiment of a wireless communication device 5. The wireless communication device 5 includes a housing 51 and an antenna structure 1 assembled to the housing 51. The wireless communication device 5 can be a data card. The antenna structure 1 can be rotated relative to the housing 51 to a better position to receive and transmit signals (such as the positions shown in FIGS. 9 and 10) and also can be rotated relative to the housing 51 to receive into the housing 51.

Figure 2:
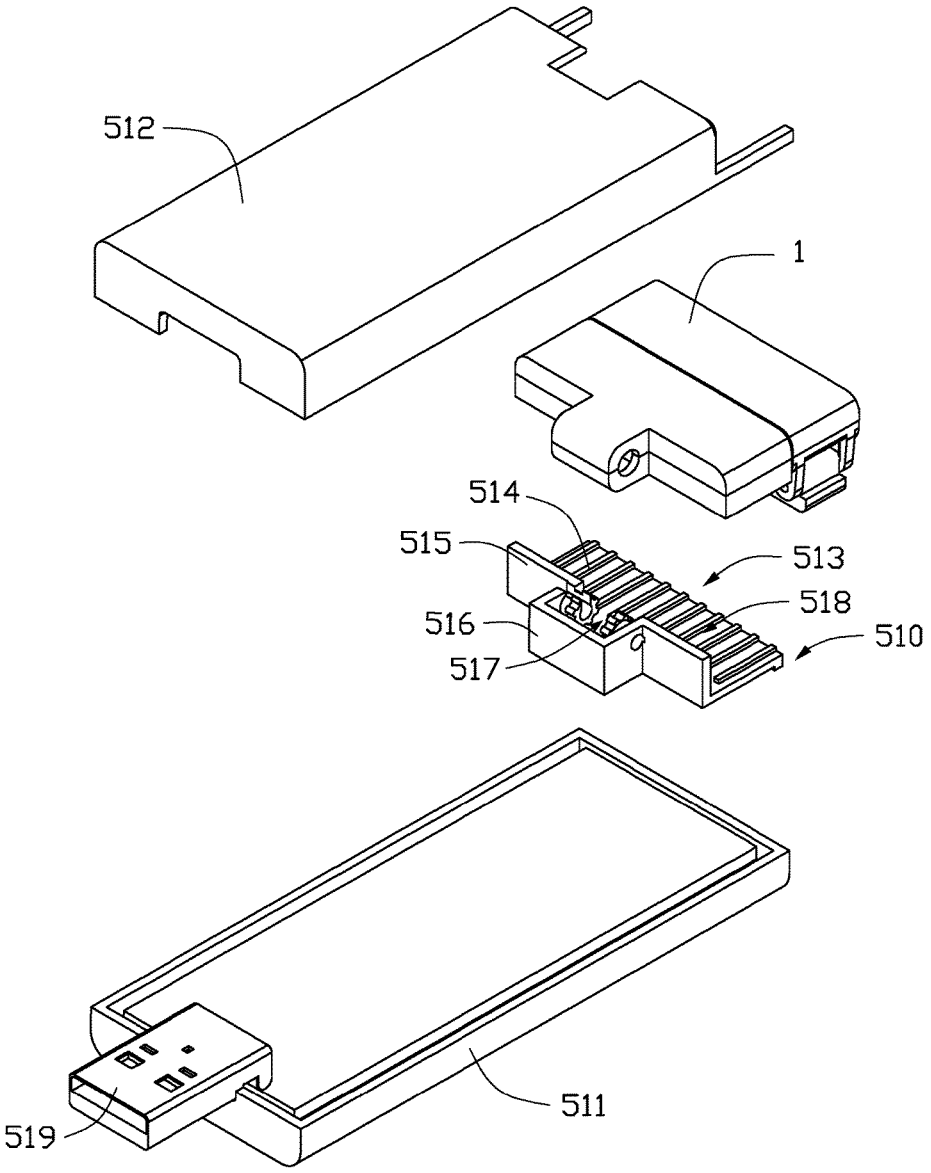
FIG. 2 is a disassembled, isometric view of a housing of the wireless communication device of FIG. 1.

FIG. 2 illustrates that a mounting portion 510 is positioned at an end of the housing 51 configured for mounting the antenna structure 1. In this exemplary embodiment, the housing 51 includes a first housing 511, a second housing 512, and a mounting member 513 sandwiched between the first cover 511 and the second cover 512. The mounting member 513 includes a plate 514, two substantially rectangular first sidewalls 515 and a substantially U-shaped second sidewall 516 perpendicularly extending from one side of the plate 514. The first sidewalls 515 and the plate 514 define a receiving portion 518 together. The second sidewall 516 and the plate 514 define a mounting slot 517. The mounting portion 510 is formed by the mounting member 513 and includes the receiving portion 518 and the mounting slot 517. A connector 519 is position at another end of housing 51 opposite to the mounting portion 510.

Figure 3:
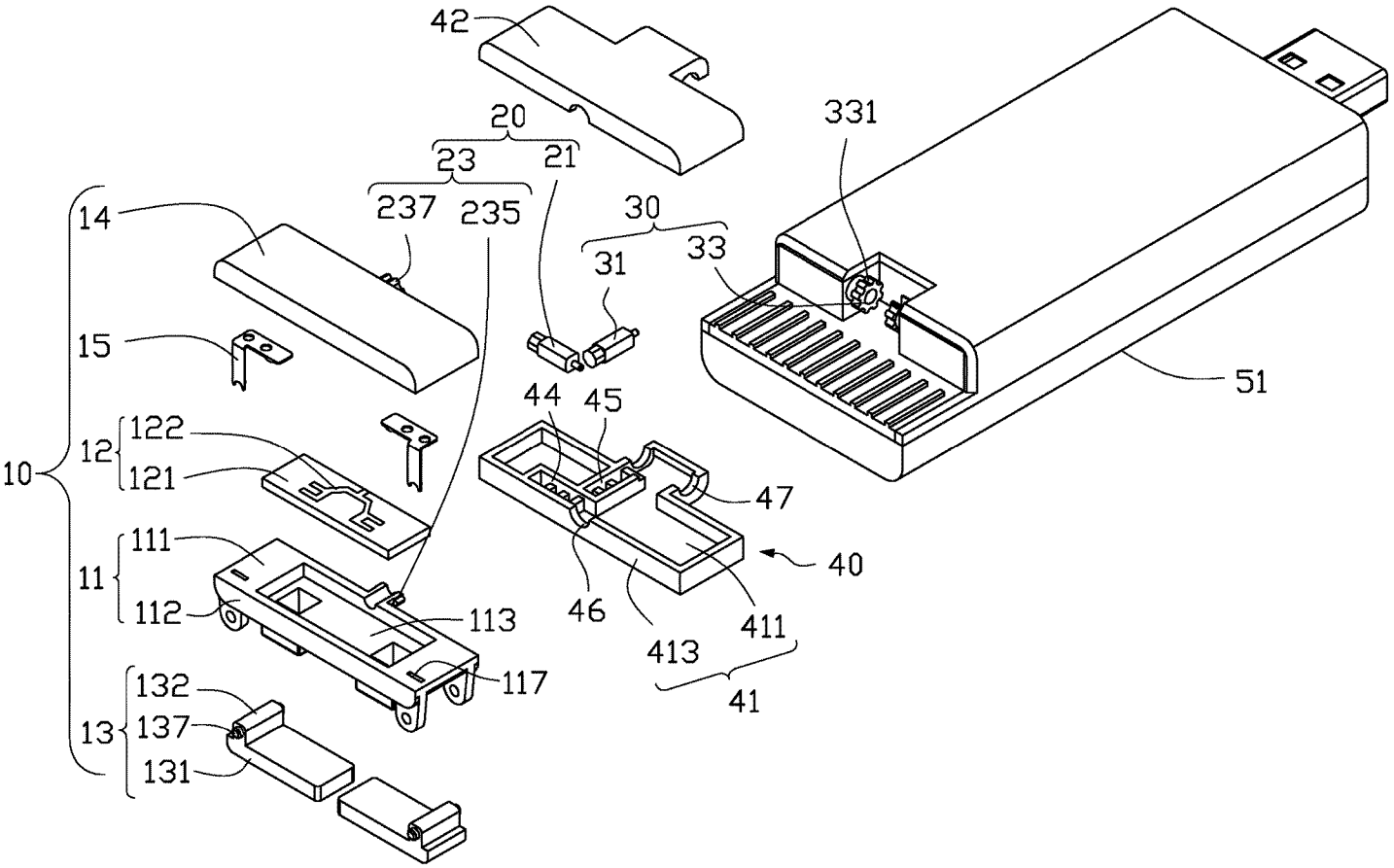
FIG. 3 is a disassembled, isometric view of an antenna structure of the wireless communication device of FIG. 1.
Figure 4:
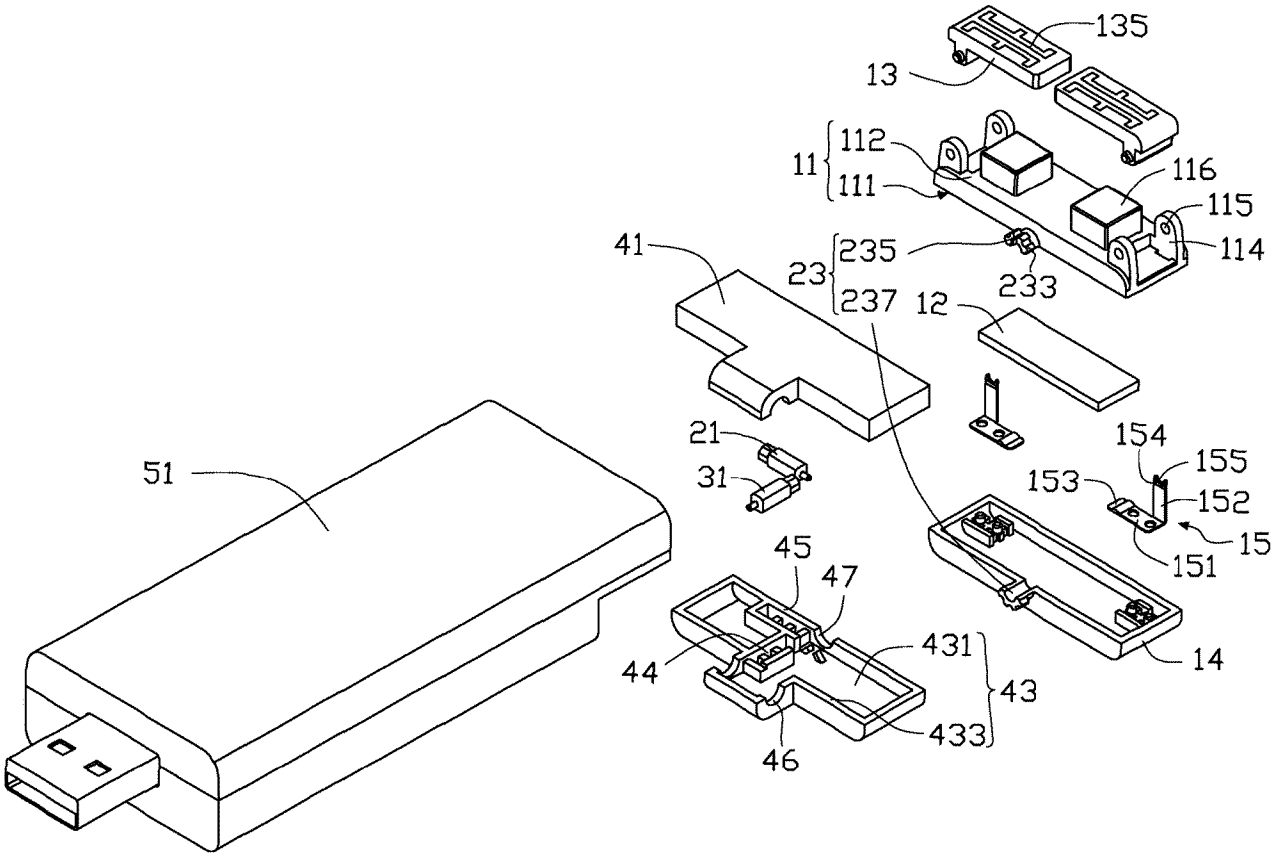
FIG. 4 is similar to FIG. 3, but shown from another aspect.

FIGS. 3 and 4 illustrates that the antenna structure 1 includes an antenna portion 10, a first rotating assembly 20, a second rotating assembly 30, and a rotatable portion 40. The antenna portion 10 is rotatably connected to the rotatable portion 40 by the first rotating assembly 20. The rotatable portion 40 is rotatably connected to the housing 51 by the second rotating assembly 30.

The antenna portion 10 includes a base 11, at least one first antenna 12, and at least one second antenna 13. In this exemplary embodiment, the antenna portion 10 includes one first antenna 12 and two second antennas 13. The base 11 includes a first surface 111 and a second surface 112 opposite to the first surface 111. A receiving slot 113 is defined in the first surface 111. The first antenna 12 is received in the receiving slot 113. Two rotating slots 114 are positioned at two opposite ends of the second surface 112. Each rotating slot 114 includes a pair of connecting holes 115. Each second antenna 13 is rotatably connected to the base 11 by one of the rotating slots 114. Two blocks 116 protrude from a middle portion of the second surface 112 and is configured for supporting the second antennas 13. In this exemplary embodiment, the antenna portion 10 further includes a cover 14 corresponding to the base 11 configured for covering the first antenna 12 to the base 11. Two mounting holes 117 are defined in the base 14. Each mounting hole 117 is adjacent to one of the rotating slots 114.

The first antenna 12 includes a first body 121 and a first pattern 122 formed on the first body 121. The first body 121 is substantially rectangular and corresponds to the shape of the receiving slot 113 so that the first body 121 can be received in the receiving slot 113.

Each second antenna 13 includes a second body 131, a rotating shaft 132 protruding from an end of the second body 131, and a second pattern 135 formed on the second main body 131 and the rotating shaft 132. Two rotating pins 137 protrude from two ends of the rotating shaft 132. The rotating pins 137 engage with the connecting holes 115 to rotatably connect the second main body 131 to the base 11.

In this exemplary embodiment, the first antenna 12 and the second antenna 13 are formed by laser direct structuring (LDS). In this exemplary embodiment, the first antenna 12 can be operated at a first frequency band of FDD LTE, the second antenna 13 can be operated at a second frequency band of TDD LTE. In another exemplary embodiment, the first antenna 12 can also be operated at a third frequency band of the 3G network, the second antenna 13 can also be operated at a fourth frequency band of WIFI. Therefore, the antenna portion 10 can be operated at multiple frequency bands.

The antenna portion 10 further includes two connecting members 15. Each connecting member 15 includes a first connecting portion 151 and a second connecting portion 152 perpendicularly extended from one side of the first connecting portion 151. A first rib 153 protrudes from an end of the first connecting portion 151. A second rib 154 protrudes from an end of the second connecting portion 152. A cut 155 is defined in the end of the second connecting portion 152 adjacent to the second rib 154. The first connecting portion 151 is pressed against the first antenna 12 and the first pattern 122. The second connecting portion 152 extends through the mounting hole 117 to contact with the second antenna 13. The cut 155 engages with the rotating pin 137. The rotating pin 137 can serve as a signal contacting point of the second antenna 13 so that the first antenna 12 and the second antenna 13 can be electronically connected to each other by the connecting member 15.

The first rotating assembly 20 includes a first hinge 21 and a first rotating member 23. The first hinge 21 is received into the rotatable portion 40. The first rotating member 23 is secured to the antenna portion 10. The first rotating member 23 can be rotated relative to the rotatable portion 40 by an external force. The first hinge 21 can resist against the first rotating member 23, thereby offsetting the first rotating member 23 from an original plane for certain degrees after the first rotating member 23 is rotated relative to the rotatable portion 40.

Figure 5:
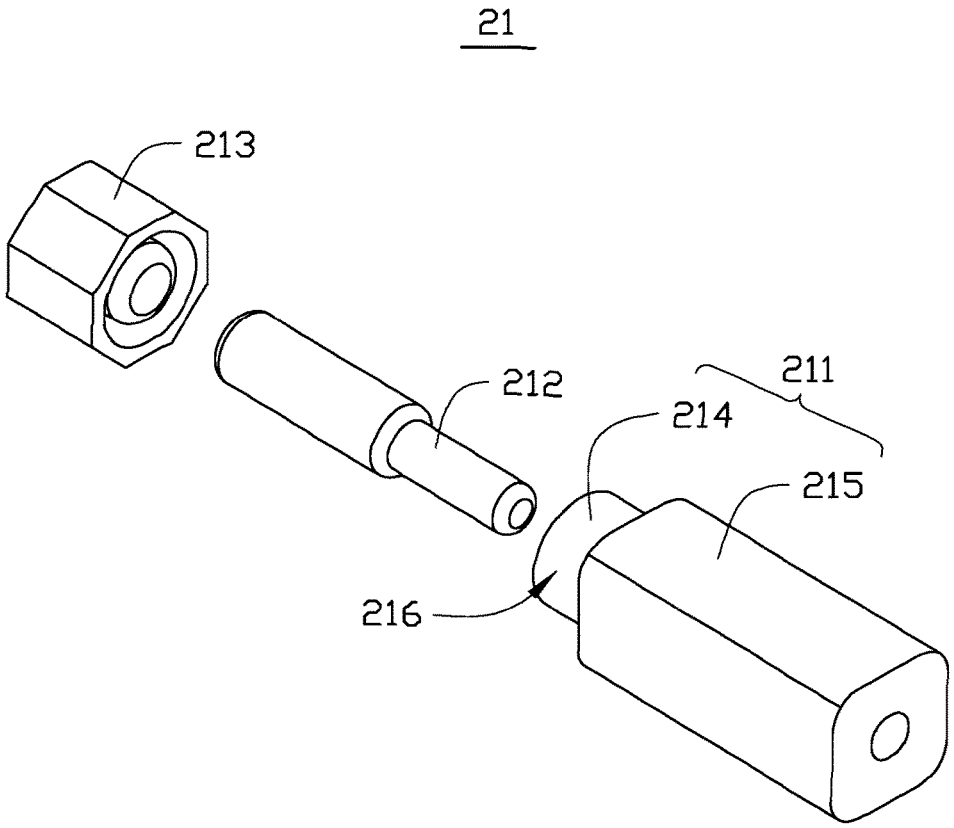
FIG. 5 is a disassembled, isometric view of a first hinge of the antenna structure of FIGS. 3 and 4.
Figure 6:
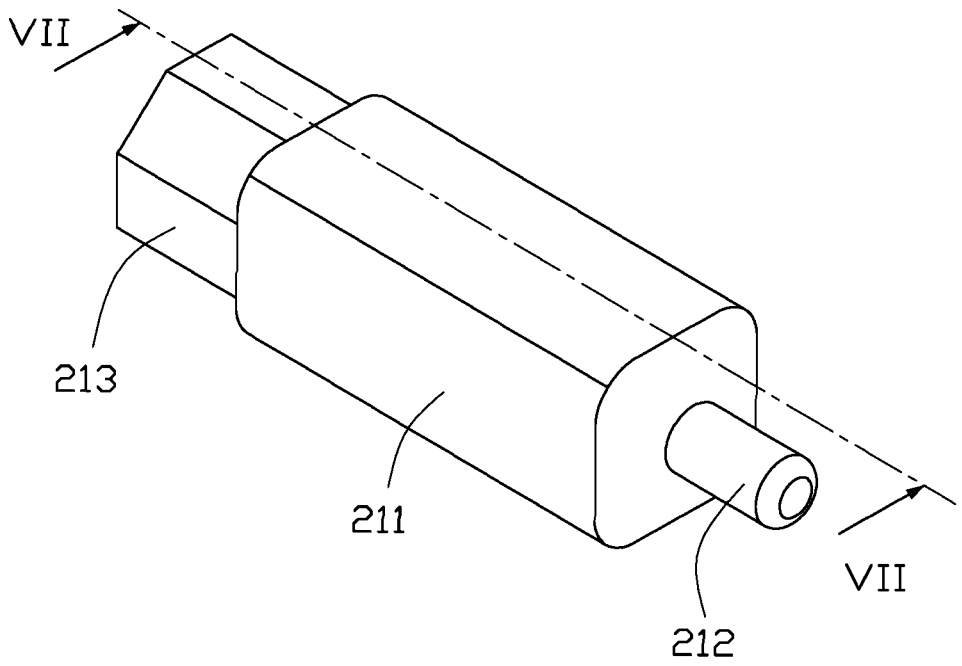
FIG. 6 is an assembled view of the first hinge of FIG. 5.
Figure 7:
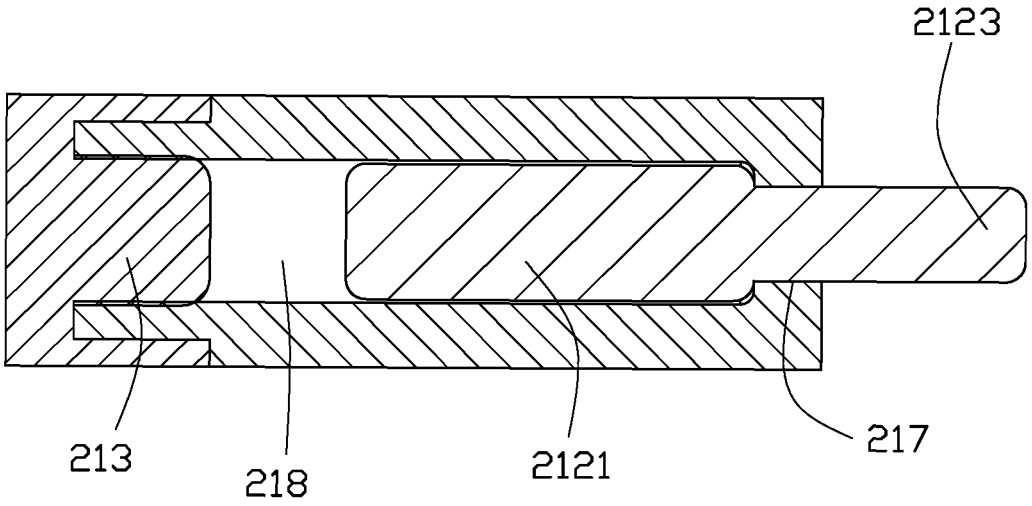
FIG. 7 is a cross-sectional view of the first hinge of FIG. 6 along line VII-VII.

FIGS. 5, 6, and 7 illustrates that the first hinge 21 includes a main body 211, a resisting rod 212, and a cap 213. The main body 211 and the cap 213 are made of Plastic plus Rubber (P+R) process. The resisting rod 212 is made of metal.

The main body 22 is a hollow cylinder. The main body 22 includes a first end portion 214 and a second end portion 215 opposite the first end portion 214. A recess 216 is formed on an outer wall of the first end portion 214. A first sliding slot 217 is defined in an inner wall of the first end portion 214. A second sliding slot 218 is defined in an inner wall of the second end portion 215 and is in air communication with the first sliding slot 217. A width of the second sliding slot 218 is wider than that of the first sliding slot 217.

The resisting rod 212 includes a rod 2121 and a resisting end 2123 formed at an end of the rod 2121. The resisting rod 212 is received in the main body 211. The rod 2121 is slidably received in the first receiving slot 217 and the resisting end 2123 is slidably received in the second receiving slot 218. The resisting end 2123 is partially exposed from the second end portion 215.

The cap 213 is coupled with the recess 216 to seal the first end portion 214 and form an enclosed and sealed space. When the first rotating member 23 is rotated by the external force, the resisting rod 212 is moved back to the enclosed and sealed space. When the external force is withdrawn, the resisting rod 212 is resisted against the first rotating member 23 to position the first rotating member 23.

The first rotating member 23 includes a gear (not labeled). A plurality of teeth 233 (shown in FIG. 4) is formed evenly spaced on a peripheral portion of the gear. In this exemplary embodiment, every two adjacent teeth 233 has a space between and an angle between the two adjacent teeth is about 45 degrees. The resisting end 2123 is positioned and resists between two adjacent teeth 233 to position the first rotating member 23. In this exemplary embodiment, the gear includes a first gear portion 235 and a second gear portion 237. The first gear portion 235 and the second gear portion 237 are fixed to the base 11 and the cover 14, respectively. When the cover 14 covers the base 11, the gear is formed. The first hinge 21 drives the resisting rod 212 to engage with the gear by air pressure of the enclosed and sealed space, replacing a conventional spring. Therefore, the first hinge 21 has a simple structure and a relative longer use time.

The second rotating assembly 30 includes a second hinge 31 and a second rotating member 33. The second hinge 31 is received in the rotatable portion 40. The second rotating member 33 is secured to the wireless communication device 5. In this exemplary embodiment, the second rotating member 33 is fixed to the second sidewall 515. The second hinge 31 can be rotated relative to the wireless communication device 5 by the external force and resists against the second rotating member 33, thereby positioning the second rotating member 33 after it is rotated relative to the wireless communication device 5 for certain degrees. The structure and principle of the second hinge 31 and the second rotating member 33 are substantially similar to those of the first hinge 21 and the first rotating member 33. Therefore, details of the structure and principle of the second hinge 31 and the second rotating member 33 are omitted.

The rotatable portion 40 includes a first case 41, and a second case 43 corresponding to the first case 41. The first case 41 includes a first bottom wall 411 and a third sidewall 413 surrounding the first bottom wall 411. The second case 43 includes a second bottom wall 431 and a fourth sidewall 431 surrounding the second bottom wall 43. A first receiving portion 44 and a second receiving portion 45 are formed on the first bottom wall 41 and the second bottom wall 43, respectively. A first cut 46 and a second opening 47 are defined in the third sidewall 413 and the fourth sidewall 433. When the first case 41 covers the second case 43, the first receiving portion 44 and the second receiving portion 45 are cooperatively formed a first receiving chamber (not labeled) and a second receiving chamber (not labeled). The first hinge 21 and the second hinge 31 are respectively received in the first receiving chamber and the second receiving chamber. The two first openings 46 of the third sidewall 413 and the fourth sidewall 433 are cooperatively formed a first receiving hole (not labeled) configured for receiving the gear of the first rotating member 23. The two second openings 47 of the third sidewall 413 and the fourth sidewall 433 are cooperatively formed a second receiving hole (not labeled) configured for receiving the gear 331 of the second rotating member 33.

Figure 8:
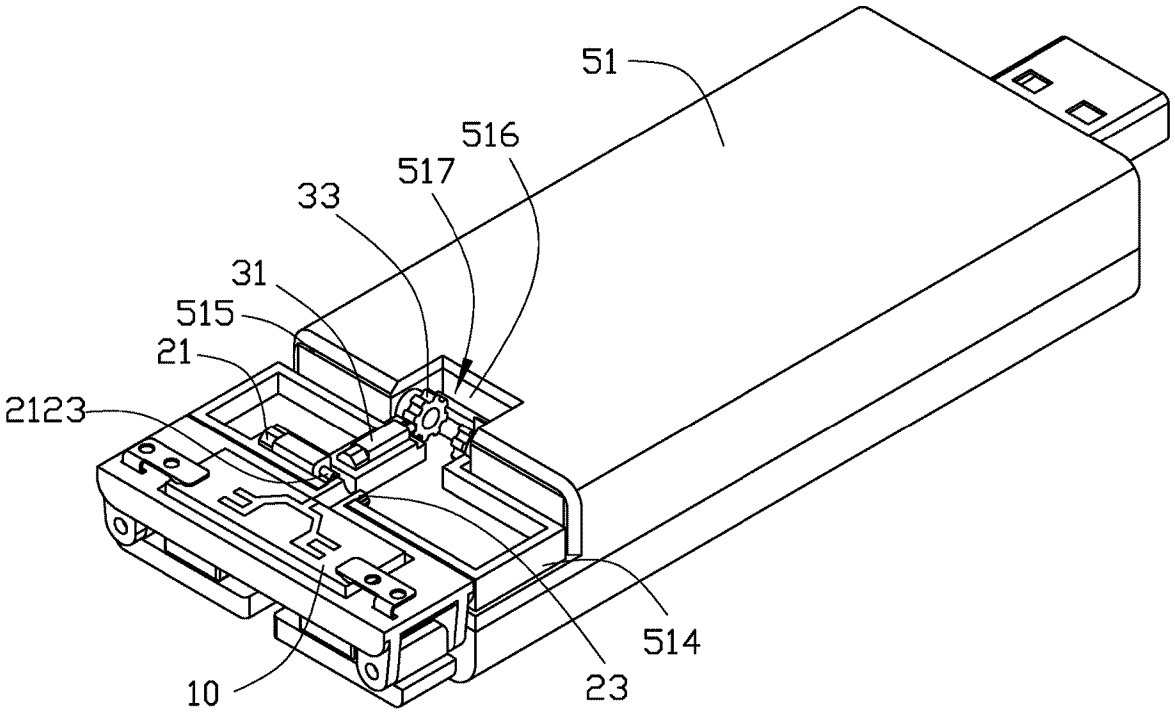
FIG. 8 is a partial assembled view of the wireless communication device of FIG. 1.

FIG. 8 illustrates that, to assemble the wireless communication device 5, the first antenna 12 is received in the receiving slot 113. The rotating pins 137 of each second antenna 13 engage in the connecting holes 115 to rotatably connect the second body 131 to the base 11. The first connecting portion 151 of each connecting member 15 is fixed to the first antenna 12 with the first rib 153 contacting with the first pattern 122. The second connecting portion 152 extends through the base 11, and sandwiched between the rotating slot 114 and the second antenna 13 with the second rib 154 contacting with the rotating pin 137. The cover 14 covers the base 11. Thus, the antenna portion 10 is assembled.

After that, the gear of the first rotating member 23 is fixed to base 11 and the cover 14, and received to the rotatable portion 40 via the first receiving hole, and aligning with the first receiving chamber. The first hinge 21 is received in the second receiving chamber and engages with the gears. The gear 331 of the second rotating member 33 is fixed to the first sidewall 515 of the housing 51. The first case 41 is positioned on the plate 514. The second hinge 31 is received in the second receiving chamber. The second hinge 31 aligns with the gear 331 of the second rotating member 33 and engages with the gear 331 of the second rotating member 33. Finally, the second case 43 covers the first case 41. The wireless communication device 5 is assembled.

Figure 9:
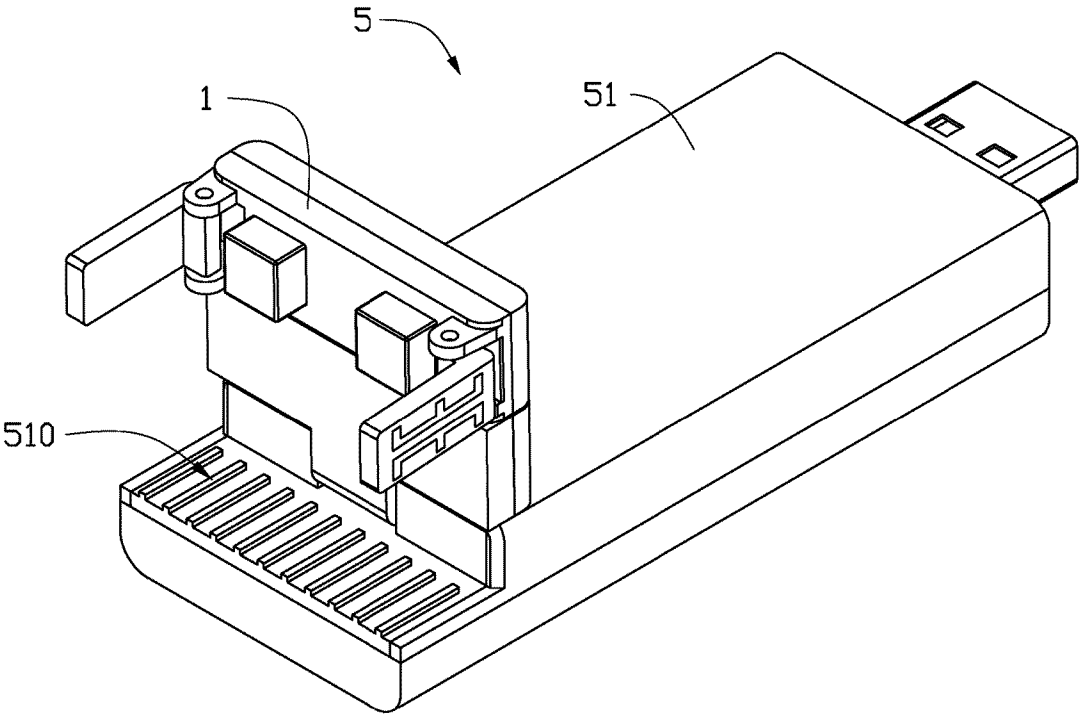
FIGS. 9 and 10 are isometric views of the wireless communication device of FIG. 1 with the antenna being rotated relative to the housing.
Figure 10:
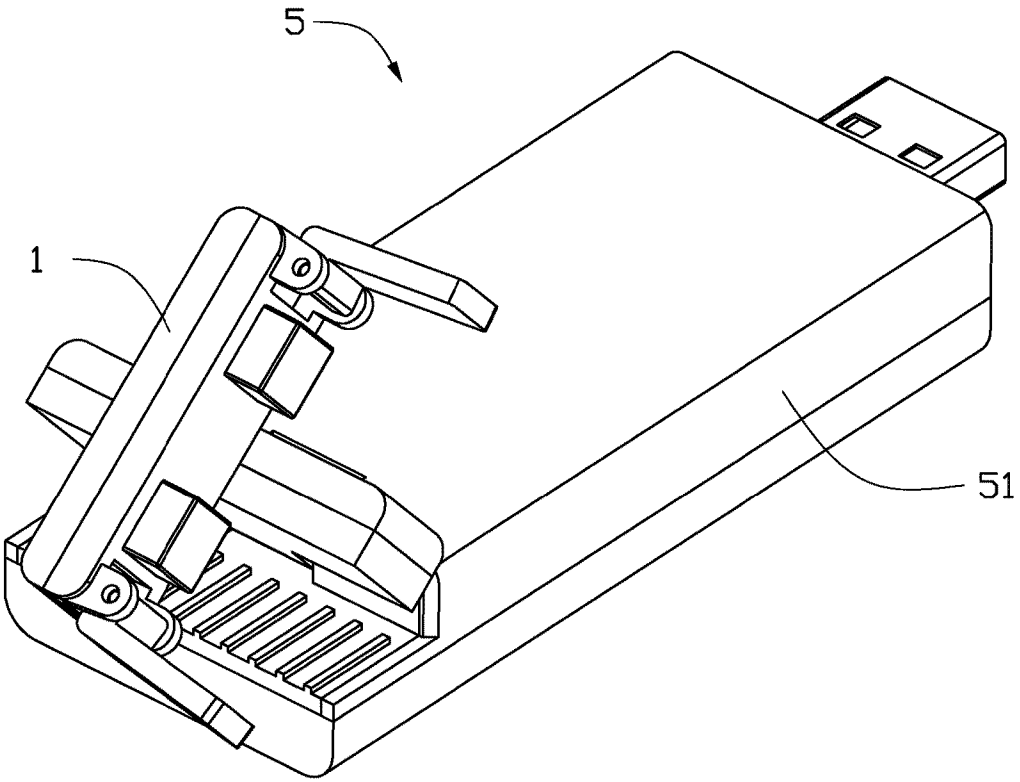

FIGS. 9 and 10 illustrates that he antenna portion 10 is rotatably connected to the rotatable portion 40. The rotatable portion 40 is rotatably connected to the wireless communication device 5 by the second rotating assembly 30. Therefore, the antenna portion 10 can rotate relative to a first central axis of the gear of the first rotating member 23 and also can rotate relative to a second central axis of the gear of the second rotating member 23 until the antenna portion 10 rotates to a position and obtains a better signal radiation performance.

It is to be understood, however, that even through numerous characteristics and advantages of the present disclosure have been set fourth in the foregoing description, together with details of assembly and function, the disclosure is illustrative only, and changes may be made in details, especially in the matters of shape, size, and arrangement of parts within the principles of the disclosure to the full extent indicated by the broad general meaning of the terms in which the appended claims are expressed.

What is claimed is:

1. An antenna structure, used in a wireless communication device, the antenna structure comprising:

an antenna portion, the antenna portion comprising: a base, a first antenna, and at least one second antenna, wherein the first antenna is received in the base, the at least one second antenna is rotatably connected to the base; and the antenna structure further comprising: a first rotating assembly, a second rotating assembly, and a rotatable portion, wherein the antenna portion is connected to the rotatable portion, the rotatable portion is rotatably connected to the wireless communication device by the second rotating assembly, whereby rotation of the second rotating assembly causes rotation of the rotatable portion and the portion of the antenna connected to the rotatable portion.

2. The antenna structure of claim 1, wherein the base comprises a first surface and a second surface opposite to the first surface, the first surface defines a receiving slot, the first antenna is received in the receiving slot, the second surface comprises two rotating slots, the second antenna is rotatably connected to the base by the rotating slots.

3. The antenna structure of claim 2, wherein the antenna portion further comprises at least one connecting member, wherein the at least one connecting member comprises a first connecting portion and a second connecting portion extending from the first connecting portion, the first connecting portion contacts the first antenna, the second connecting portion extends through the base to contacts the second antenna.

4. The antenna structure of claim 1, wherein the first rotating assembly comprises a first hinge and a first rotating member, the first hinge is received in the rotatable portion, the antenna portion connected to the first rotating member, the first rotating member is rotatable relative to the rotatable portion, the first hinge resists against the first rotating member, thereby positioning the first rotating member.

5. The antenna structure of claim 4, wherein the second rotating assembly comprises a second hinge and a second rotating member, the second hinge is received in the rotatable portion, the second rotating member is fixed to the wireless communication device, the second rotating member is rotatable relative to the rotatable portion, the second hinge resists against the second rotating member, thereby positioning the second rotating member.

6. The antenna structure of claim 5, wherein:

each of the first hinge and second hinge comprises a main body, a resisting rod, and a cap;

wherein each main body comprises a first end portion defining a first sliding slot and a second portion opposite the first end portion defining a second sliding slot, the first sliding slot is in communication with the second sliding slot, the resisting rod is received in the main body and is partially exposed from the second end portion, the cap seals the first end portion to form a sealed space.

7. The antenna structure of claim 5, wherein each of the first rotating member and the second rotating member comprises a gear having a plurality of teeth formed evenly spaced on a peripheral portion of the gear, the resisting rod is positioned and resists between two adjacent teeth of the gear to position the first rotating member.

8. The antenna structure of claim 3, wherein:

the at least one second antenna comprises a body, a rotating shaft protruding from an end of the body, and a pattern formed on the body; and the rotating shaft comprises two rotating pins, the rotating pins engage with the rotating slots to rotatably connect the body to the base.

9. The antenna structure of claim 8, wherein the second connecting portion defines a cut, and the cut engages with one of the rotating pins.

10. A wireless communication device, comprising:

a housing; and an antenna structure assembled to the housing, the antenna structure comprising:

an antenna portion, the antenna portion comprising a base, a first antenna and at least one second antenna, wherein the first antenna is received in the base, the at least one second antenna is rotatably connected to the base; wherein the antenna structure further comprises a first rotating assembly, a second rotating assembly, and a rotatable portion, wherein the antenna portion is connected to the rotatable portion, the rotatable portion is connected to the wireless communication device by the second rotating assembly, whereby rotation of the second rotating assembly causes rotation of the rotatable portion and the portion of the antenna connected to the rotatable portion.

11. The wireless communication device of claim 10, wherein the base comprises a first surface and a second surface opposite to the first surface, the first surface defines a receiving slot, the first antenna is received in the receiving slot, the second surface comprises two rotating slots, the second antenna is rotatably connected to the base by the rotating slots.

12. The wireless communication device of claim 11, wherein the antenna structure further comprises at least one connecting member, wherein the at least one connecting member comprises a first connecting portion and a second connecting portion extending from the first connecting portion, the first connecting portion contacts the first antenna, the second connecting portion extends through the base to contacts the second antenna.

13. The wireless communication device of claim 10, wherein the first rotating assembly comprises a first hinge and a first rotating member, the first hinge is received in the rotatable portion, the antenna portion connected to the first rotating member, the first rotating member is rotatable relative to the rotatable portion, the first hinge resists against the first rotating member, thereby positioning the first rotating member.

14. The wireless communication device of claim 13, wherein the second rotating assembly comprises a second hinge and a second rotating member, the second hinge is received in the rotatable portion, the second rotating member is fixed to the wireless communication device, the second rotating member is rotatable relative to the rotatable portion, the second hinge resists against the second rotating member, thereby positioning the second rotating member.

15. The wireless communication device of claim 14, wherein each of the first hinge and second hinge comprises a main body, a resisting rod, and a cap; wherein each main body comprises a first end portion defining a first sliding slot and a second portion opposite the first end portion defining a second sliding slot, the first sliding slot is in communication with the second sliding slot, the resisting rod is received in the main body and is partially exposed from the second end portion, the cap seals the first end portion to form a sealed space.

16. The wireless communication device of claim 14, wherein each of the first rotating member and the second rotating member comprises a gear having a plurality of teeth formed evenly spaced on a peripheral portion of the gear, the resisting rod is positioned and resists between two adjacent teeth of the gear to position the first rotating member.

17. The wireless communication device of claim 12, wherein the at least one second antenna comprises a body, a rotating shaft protruding from an end of the body, and a pattern formed on the body; and the rotating shaft comprises two rotating pins, the rotating pins engage with the rotating slots to rotatably connect the body to the base.

18. The wireless communication device of claim 17, wherein the second connecting portion defines a cut, and the cut engages with one of the rotating pins.

* * * * *